United States Patent [19]

Westgerdes

[11] Patent Number: 4,586,203

[45] Date of Patent: May 6, 1986

[54] SINK STRAINER ASSEMBLY

[75] Inventor: James J. Westgerdes, Ft. Recovery, Ohio

[73] Assignee: Fort Recovery Industries, Inc., Fort Recovery, Ohio

[21] Appl. No.: 660,890

[22] Filed: Oct. 15, 1984

[51] Int. Cl.[4] ..... A47K 1/14

[52] U.S. Cl. ..... 4/287; 4/295

[58] Field of Search ..... 4/286–295; 210/163–166

[56] References Cited

U.S. PATENT DOCUMENTS

| | | | |
|---|---|---|---|
| 2,225,693 | 12/1940 | Frances | 285/25 |
| 2,890,463 | 6/1959 | Young | 4/287 |
| 3,588,928 | 6/1971 | Hiertz | 4/287 |
| 3,777,320 | 12/1973 | Politz | 4/287 |
| 3,800,339 | 4/1974 | Bergin | 4/287 |
| 3,802,001 | 4/1974 | Richards | 4/287 |
| 4,320,540 | 3/1982 | Leavens | 4/292 X |

FOREIGN PATENT DOCUMENTS

| | | | |
|---|---|---|---|
| 728976 | 4/1955 | United Kingdom | 4/287 |

*Primary Examiner*—Charles E. Phillips

*Attorney, Agent, or Firm*—Wood, Herron & Evans

[57] ABSTRACT

A sink strainer assembly includes a strainer body adapted to fit in the drain opening of a sink having a threaded bore and an annular shoulder in its interior, a strainer basket having a bottom wall formed with a bore, a post formed with a top handle, a bottom threaded portion and a reduced diameter middle portion, and a rubber stopper having a bore of the same diameter as the middle portion of the post. The strainer basket is mounted to the post by inserting the post through the bore in the strainer basket so that its top handle extends atop the bottom wall and the middle section of the post extends beneath the bottom wall. The rubber stopper is then forced over the threaded bottom portion of the post and seats within the middle portion in contact with the underside of the strainer basket to mount the strainer basket to the post. The strainer basket, post and stopper are thereafter inserted as a unit into the strainer body where the threaded bottom portion of the post mates with the threaded bore of the strainer body. The post is rotatable to lower the rubber stopper into sealing engagement with the annular shoulder to fill the sink, or raise the rubber stopper from the annular shoulder for draining.

1 Claim, 2 Drawing Figures

SINK STRAINER ASSEMBLY

BACKGROUND OF THE INVENTION

This invention relates to strainer assemblies for the drain openings of sinks, and, more particularly, to a strainer assembly of the type having a threaded connection between the strainer basket and strainer body.

One prior art sink strainer assembly generally includes a strainer body mounted to the sink drain opening and formed with a slot at the bottom, a strainer basket having a flexible stopper along its outer surface which is adapted to contact the interior wall of the strainer body, and a strainer post mounted to the strainer basket and having a stem at one end which extends beneath the strainer basket and is adapted to be placed in or out of engagement with the slot in the strainer body. By manipulating the post so that the stem aligns with and drops into the slot, the strainer basket is moved downwardly within the strainer body so that the flexible stopper engages the sides of the strainer body and creates a seal therebetween allowing the sink to hold liquid. To drain the sink of liquid, the post and strainer basket are lifted and turned 90° so that the stem rests atop the slot in the strainer body. This lifts the flexible stopper of the strainer basket out of contact with the sides of the strainer body and breaks the seal therebetween.

One problem with this prior art design is that it is often difficult to manipulate the post so that it either drops into or rests atop the slot in the strainer body, particularly with slippery hands from dish water and the like. Another problem is that a poor seal is created between the rubber stopper of the strainer basket and the walls of the strainer body. This is because only the weight of the strainer basket urges the stopper into contact with the walls of the strainer body and most strainer baskets in use are lightweight.

One proposed solution to the problems of manipulating the strainer basket and post within the strainer body, and providing a good seal between the strainer basket and strainer body, has been to replace the slot in the bottom of the strainer body with a threaded bore and form the stem of the post which extends beneath the strainer basket with threads. The threaded stem of the post is long enough so that it can be partially threaded within the strainer body without the flexible stopper mounted on the outside of the strainer basket contacting the walls of the strainer body. It normally remains in this position during use of the sink to permit drainage. In order to seal the drain opening of the sink to wash dishes or the like, the post is simply tightened further into the threaded bore of the strainer body until the flexible stopper of in the strainer basket is secured against the walls of the strainer body. The threaded connection between the strainer basket and strainer body effects a much better seal than can be obtained by the weight of the strainer basket alone.

Sink strainer assemblies having a threaded connection between the post and strainer body, such as described above are shown, for example, in U.S. Pat. Nos. 2,225,693; 2,890,463; 3,800,339; and 3,777,320. One problem shared by all of these patented sink strainer assemblies is that too many parts are required to connect the strainer basket to the strainer body, which adds to the cost and increases the difficulty of assembling the device. In some designs, such as shown in U.S. Pat. No. 3,800,339, the post, stopper and strainer basket are not interconnected as a unit for insertion into the strainer body but are separate pieces. This can create problems of lost parts in the shipment of the strainer assembly, or misplacement of parts when the assembly is removed from the sink for cleaning or repair.

SUMMARY OF THE INVENTION

It is therefore among the primary objects of this invention to provide a sink strainer assembly which is easily located within the strainer body, which is adapted to create a reliable watertight seal between the strainer basket and the strainer body, which is simple and economical to manufacture and assemble and which provides for the interconnection of the strainer basket, stopper and post as a unit with a minimum number of parts.

These objectives are accomplished in a sink strainer assembly including a strainer body having a threaded bore at its bottom end and an inner wall formed with a tapered annular shoulder, which is adapted to fit in the drain opening of a sink. A strainer basket, formed with a plurality of circumferential slots and having a central bore formed in its bottom wall, is adapted to be inserted within the strainer body. A post is provided having a handle at its top end, a threaded portion at its bottom end and a portion of reduced diameter therebetween. A flexible stopper made of resilient material, such as rubber, is formed with a center bore of approximately the same diameter as the reduced diameter portion of the post.

The sink strainer assembly is assembled in the following manner. The post is first inserted through the bore in the strainer basket so that the handle at its top end engages the bottom wall of the basket and the reduced diameter portion extends below the basket. The flexible stopper is then urged over the bottom threaded portion of the post and up to the reduced diameter portion where it seats. Since the reduced diameter portion of the post is located beneath the strainer basket, the strainer basket is captured between the handle of the post and the rubber stopper. The larger diameter threaded portion of the post prevents the stopper from moving downwardly along the post, so the post, strainer basket and stopper are connected together as a unit and will not come apart unless the rubber stopper is forcefully removed from its seat on the reduced diameter portion.

The strainer basket, post and stopper unit is then inserted within the strainer body of the assembly. The threaded portion of the post engages the mating threads of the bore of the strainer body to locate the unit in place. The threaded portion of the post is long enough so that when partially threaded into the bore of the strainer body, the rubber stopper is located above the tapered seat in the strainer body. This permits the sink to continuously drain. In order to seal the drain opening of the sink for washing dishes and the like, the post is simply lowered by threading it further into the bore of the strainer body until the rubber stopper seats against the tapered annular shoulder of the strainer body. If desired, the strainer basket, post, and stopper unit can be completely removed from the sink for cleaning.

The sink strainer assembly of this invention is easily located within the strainer body, provides a reliable seal of the drain opening of the sink and includes a minimum number of parts which are easy to manufacture and assemble. In addition, the post, strainer basket and rubber stopper are connected together as a unit with a minimum number of parts.

DESCRIPTION OF THE DRAWINGS

The structure, operation and advantages of this invention will become further apparent upon consideration of the following description taken in conjunction with the accompanying drawings, wherein.

DETAILED DESCRIPTION OF THE INVENTION

Figure 1:
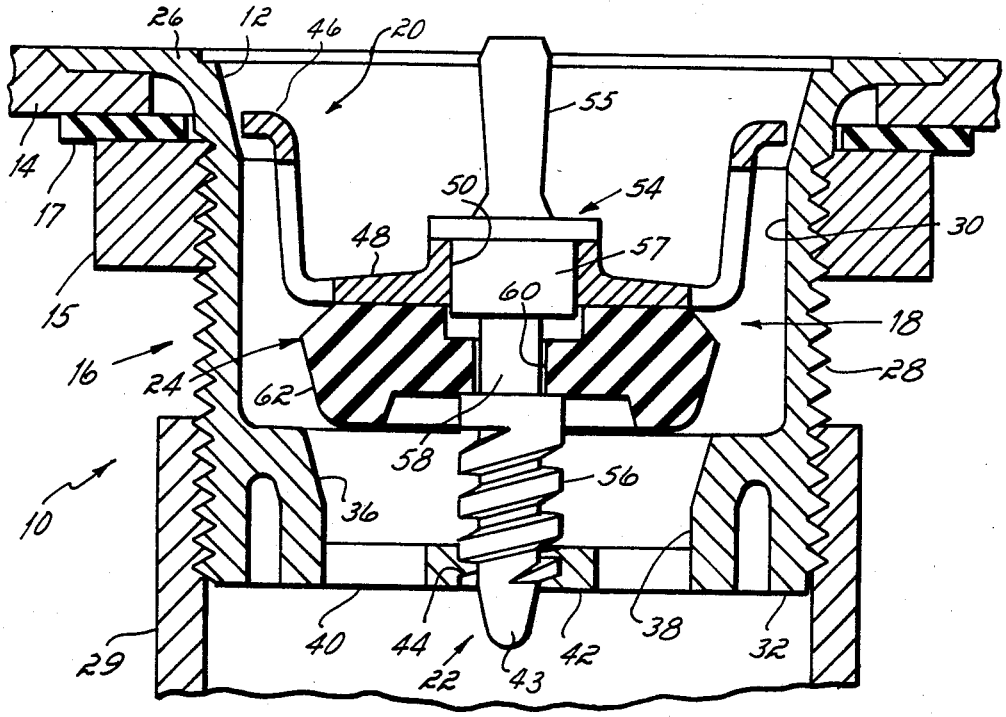
FIG. 1 is a front view in partial cross-section of the sink strainer assembly of this invention in place within a sink drain opening in a raised or draining position.
Figure 2:
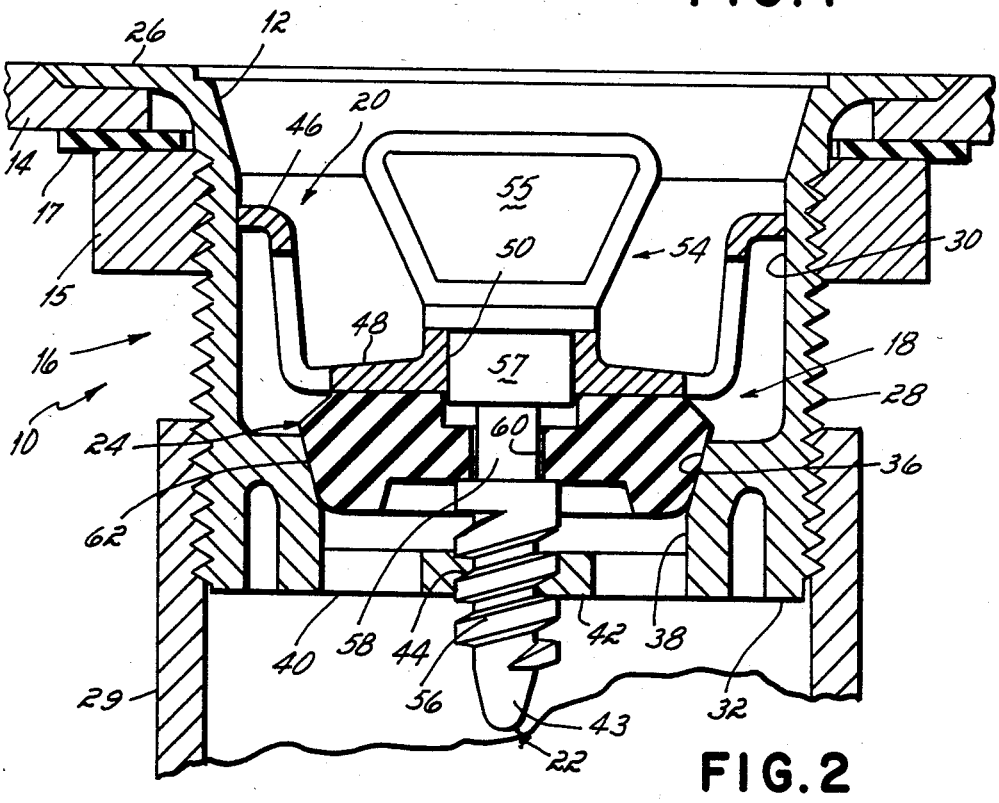
FIG. 2 is the same as FIG. 1 except the sink strainer assembly herein is positioned in a lowered or sealing position.

Referring now to the drawings, the sink strainer assembly 10 of this invention is shown in position within the drain opening 12 of a sink 14 mounted to a countertop 15 over a rubber gasket 17. The sink strainer assembly 10 comprises a strainer body 16, and a strainer unit 18 including a strainer basket 20, a post 22 and a stopper 24 which are adapted to be interconnected to form the strainer unit 18. The strainer unit 18 is adapted to be inserted within the strainer body 16 and is manipulated to assume a raised, drain position as shown in FIG. 1 or a lowered, sealing position as shown in FIG. 2. If desired, the strainer unit 18 can be completely removed from the strainer body 16 for cleaning.

The strainer body 16 is preferably formed of cast metal, such as zinc alloy and includes an upper annular flange 26 adapted to seat within the drain opening 12 of the sink 14, and an outer threaded surface 28. The outer threaded surface 28 of strainer body 16 is conventionally adapted to mate with the threaded fitting of a drain pipe 29. The interior of strainer body 16 is formed with an inner wall 30 which tapers gradually inwardly from the flange 26 toward the bottom 32 of the strainer body 16. Near the bottom 32 of strainer body 16, the inner wall 30 extends radially inwardly and forms an annular shoulder 36 which tapers downwardly toward the bottom 32 of the strainer body 16. A vertical wall 38 extends from the annular shoulder 36 to the bottom 32 of strainer body 16. Extending radially inwardly from the vertical wall 38 are spaced, radial supports 40 which mount a center section 42 formed with a threaded bore 44 approximately in the center of strainer body 16.

An important feature of this invention is that the strainer basket 20, post 22 and stopper 24 forming the remainder of sink strainer assembly 10 are interconnected to form a strainer unit 18 for insertion into the interior of strainer body 16. The strainer basket 20 is cup-shaped and includes an upper flange 46, a bottom wall 48 and a bore 50 formed in the bottom wall 48. Conventionally, the sides and/or bottom wall 48 of strainer basket 20 are formed with a plurality of spaced openings or slots (not shown) which permit drainage of liquid but filter solid objects from the liquid to prevent their escape into the drain lines of the sink. The post 22 is formed with a handle 54 at its top end having a finger gripping portion 55 connected to a plug 57, a threaded portion 56 at the bottom end, and a middle portion 58 therebetween. As shown in the drawings, the diameter of middle portion 58 is less than the diameter of either the plug 57 of the handle 54 or the threaded portion 56. The stopper 24 is a generally annular section of rubber or a similar resilient material formed with a center bore 60 having about the same diameter as the middle portion 58 of post 22, and an outer tapered surface 62.

The strainer unit 18 is assembled in the following manner. The post 22 is first inserted through the bore 50 in the bottom wall 48 of strainer basket 20 so that the gripping portion 55 of its handle 54 engages the bottom wall 48 of the plug 57 of handle 54 extends into the bore 50. With the post 22 in this position, the reduced diameter middle portion 58 extends beneath the bottom wall 48 of strainer basket 20. The rubber stopper 24 is then forced over the threaded portion 56 of post 22 and seats within the smaller diameter middle portion 58. Although the bore 60 formed in stopper 24 is of smaller diameter than the threaded portion 56 of post 22, it is sufficiently flexible to be stretched over the threaded portion 56 and then maintain the original diameter of its center bore 60. When the stopper 24 is seated within middle portion 58, it is squeezed between the underside of strainer basket 20 and the threaded portion 56 of post 22. In turn, the bottom wall 48 of strainer basket 20 is captured between the gripping portion 55 of handle 54 on top and the stopper 24 beneath, which interconnects the strainer basket 20, post 22 and stopper 24. Therefore, when assembled, the strainer basket 20, post 22 and stopper 24 form an interconnected strainer unit 18 which can be separated only by forcing the stopper 24 over the larger diameter threaded portion 56 of post 22.

The strainer unit 18 is located within the strainer body 16 by simply engaging the threaded portion 56 of post 22 within the mating threads of the bore 44 formed in the center section 42 of strainer body 16. In FIG. 1, the threaded section of the post rests atop the threaded bore 44 of strainer body 16 with the bottom tapered end or guide end 43 of the post protruding from the bottom of the bore 44 so that the strainer basket 20 and stopper 24 are maintained in a raised position above the annular shoulder 36 formed in the interior of strainer body 16. In this position, liquid is permitted to travel through the strainer basket 20, along the inner wall 30 of the strainer body 16 and out the spaces (not shown) between the radial supports 40. By rotating the post 22 clockwise, the threaded post is threaded into the threaded bore 44 and the outer tapered surface 62 of stopper 24 is lowered within the strainer body 16 and brought into sealing engagement with the annular shoulder 36 as shown in FIG. 2. This effectively seals liquid from escaping through the bottom of strainer body 16 because the stopper 24 is urged tightly against the strainer body 16 by tightening post 22 as desired. The post 22 may be rotated in the opposite, counterclockwise direction to raise the stopper 24 and unseat it from the annular shoulder 36 for draining as shown in FIG. 1.

In addition, the strainer unit 18 may be completely removed from strainer body 16 for cleaning. When removed from the strainer body 16, the strainer basket 20, post 22 and stopper 24 remain together as a unit 18 to lessen the chance of separating or losing the parts.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best most contemplated for carrying out this invention, but that the invention will include all embodiments falling within the scope of the appended claims.

What is claimed is:

1. A sink strainer assembly comprising:

a strainer body having a lower threaded bore and an interior wall formed with a shoulder seat;

a strainer basket having a bottom wall formed with an axial bore;

a post having a handle top portion, a center portion, and a threaded bottom portion, said threaded bottom portion being adapted to mate with said threaded bore of said strainer body, said center portion of said post extending through said bore in said strainer basket and said threaded bottom portion of said post extending beneath said bottom wall of said strainer basket;

a unitary single-piece resilient stopper having an axial bore which is smaller in diameter than said threaded bottom portion of said post and approximately the same diameter as said center portion of said post, the bore of said stopper being forced over said threaded bottom portion of said post and onto said center portion of said post so as to secure said strainer basket to said post between aid handle top portion and said threaded bottom portion thereof;

said strainer basket, post and stopper being adapted to be inserted within said strainer body so that said threaded bottom portion of said post engages said threaded bore of said strainer body, said post being rotatable in one direction to lower said strainer basket and urge said stopper against said shoulder seat of said strainer body forming a seal therebetween, said post being rotatable in the opposite direction to raise said strainer basket and lift said stopper from said shoulder of said strainer body for breaking said seal, said center portion of said post including a section of reduced diameter formed in said post above said threaded bottom portion and beneath said strainer basket, said stopper being seated over said section of reduced diameter in engagement with said bottom wall of said strainer basket, said stopper thereby mounting said strainer basket to said post, said reduced diameter section of said center portion of said post being smaller in cross section than said top portion and said threaded bottom portion of said post, and said post and strainer basket being assembled by insertion of said threaded bottom portion and said center portion through said central bore of said strainer basket so that said top portion of said post extends atop said bottom wall of said strainer basket and said center portion of said post extends beneath said bottom wall of said strainer basket, said threaded bottom portion of said post thereafter being inserted through said central bore of said stopper, said stopper seating within said center portion of said post and contacting the underside of said bottom wall of said strainer basket, said bottom wall of said strainer basket being captured between said top section of said post and said stopper whereby said strainer basket, post and stopper are releasably connected together as a unit.

* * * * *